US005265379A

United States Patent [19]

Panetti

[11] Patent Number: 5,265,379

[45] **Date of Patent: * Nov. 30, 1993**

[54] DEVICE FOR THE REPROFILING OF THE RAILS OF RAILWAY TRACK

[75] Inventor: Romolo Panetti, Geneva, Switzerland

[73] Assignee: Speno International SA, Geneva, Switzerland

[ * ] Notice: The portion of the term of this patent subsequent to Feb. 19, 2008 has been disclaimed.

[21] Appl. No.: 834,765

[22] Filed: Feb. 13, 1992

[30] Foreign Application Priority Data

Mar. 1, 1991 [CH] Switzerland ..... 652/91

[51] Int. Cl.[5] ..... B24B 23/03; B24B 23/04

[52] U.S. Cl. ..... 51/178; 51/241 LG

[58] Field of Search ..... 51/178, 241 LG, 74 R

[56] References Cited

U.S. PATENT DOCUMENTS

| | | | |
|---|---|---|---|
| 4,135,332 | 1/1979 | Theurer | 51/178 |
| 4,205,494 | 6/1980 | Rivoire | 51/178 |
| 4,615,150 | 10/1986 | Panetti | 51/178 |
| 4,862,647 | 9/1989 | Vieau | 51/178 |
| 4,905,422 | 3/1990 | Panetti | 51/178 |
| 4,993,193 | 2/1991 | Panetti | 51/178 |
| 5,086,591 | 2/1992 | Panetti | 51/178 |

FOREIGN PATENT DOCUMENTS

| | | |
|---|---|---|
| 0145919 | 6/1985 | European Pat. Off. . |
| 0235602 | 9/1987 | European Pat. Off. . |
| 0344390 | 12/1989 | European Pat. Off. . |
| 2612173 | 6/1977 | Fed. Rep. of Germany . |
| 2612174 | 6/1977 | Fed. Rep. of Germany . |
| 2333897 | 7/1977 | France . |
| 606616 | 11/1978 | Switzerland . |
| 633336 | 11/1982 | Switzerland . |
| 675440 | 9/1990 | Switzerland . |
| 1151010 | 5/1969 | United Kingdom . |

*Primary Examiner*—Bruce M. Kisliuk
*Assistant Examiner*—Bo Bounkong
*Attorney, Agent, or Firm*—Young & Thompson

[57] ABSTRACT

A device for the reprofiling of a rail on a railway track comprises a rigid frame (10) connected to the framing of a railroad vehicle by a lifting arrangement which permits a light running of the railroad vehicle, and at least one grinding unit (11,12). Each grinding unit (11,12) is mounted on a support (13) in such a way that it can displace itself linearly to move the grinding wheel towards and away from the surface of the rail to be grinded. The grinding wheel's axis is located in a plane perpendicular to the longitudinal axis of the rail (1,2) but does not intersect it so that the contact line of the grinding wheel with the surface of the rail (1,2) will be located in a plane perpendicular to the longitudinal axis of the rail. The support (13) is mounted to the frame (10) by cranks (16) which together with the frame and the support form a deformable parallelogram which permits the support to move itself transversally with respect to the frame (10). The support (13) comprises at least one support roller (17) and a jack (18), connecting this support (13) to the frame (10) and tending to apply this support roller against one of the sides of the rail (1,2) in close proximity to the grinding unit (11,12).

10 Claims, 9 Drawing Sheets

DEVICE FOR THE REPROFILING OF THE RAILS OF RAILWAY TRACK

FIELD OF THE INVENTION

The present invention relates to the reprofiling and more particularly to the final burnishing of the rails of a railway track by grinding and/or reprofiling the rails of a railway track and specially in its small radius curve.

BACKGROUND OF THE INVENTION

One uses actually for the reprofiling of the rails, machines comprising controlled grinding units as disclosed in patents CH 606.616 or CH 633.336; These devices present the drawback that one must reposition the grinding wheel against the rail at each angular adjustment of the angle of the grinding wheel. Furthermore, the angular amplitude of the pivoting of the grinding units is limited.

The patent GB-A-1.151.010 also discloses a device for reprofiling the rail head of at least one rail, comprising a support carrying at least one grinding unit, presenting at least one grinding wheel driven in rotation by a motor and means of axial displacement of that grinding wheel to apply it against a side line of the head of the rail thus compensating its wearing off.

A well known problem for the rail reprofiling machines is that one must be able to grind the inside side, the running table and the outside side of the rail with the same grinding wheel. This is especially imperative when preparing the rails for their mutual replacement. With existing machines, this can only be achieved with time consuming manual regulation and bulky grinding units, because their axial stroke, parallel to the rotation axis of the grinding wheel are necessarily important, finally these great axial strokes affect the precision of the grinding.

The EP 0 145 919 patent discloses a machine having one or more grinding wheel which can pivot on a large angle, namely, about 180°, which is a much greater angle than on existing machines, thus avoiding conflict, during the grinding wheel's rotation, between the grinding wheel and other object such as fish plate or coach screw present along the railway track. Furthermore, to insure a high quality of grinding, one must avoid a change in the grinding wheel position which implies an important correction of its axial position, parallel to its rotation axis, in order to bring it back in contact with the rail.

In all these embodiments, the grinding units are mounted on trolleys or underframes suspended under a railroad vehicle and resting on one of the rails by means of a guide roller. Therefore, the grinding reference plane is defined by the rolling surface of the rail which is worked on, and not by the plane of the track. Once the rail is badly worn, the running table plane is modified in such a way that the reprofiling of the rail is carried out on the basis of an imprecise reference plane. Moreover, due to the use of pivoting grinding units comprising a motor which drives two grinding wheels in rotation, the height of these units requires an important available space under the railroad vehicle, and therefore becomes difficult to locate guide carriages under it.

The reprofiling device disclosed in the patent CH 675.440 remedies this drawback by mounting the grinding units on the framing of a railroad vehicle which comprises a two-wheel axle at one of its extremity and which is articulated around an axis parallel to the longitudinal axis of the railway at its other extremity on a rigid frame having two wheels. Thus, the framing is guided by the railway track and defines a reference plane parallel to the plane of the railway track.

All the previously reviewed devices use grinding wheels having a planar working surface which leaves, after the grinding process, longitudinal facets on the head of the rail. Furthermore, the use of lapidary grinding wheels give rise to scratches transversal to the rail. When grinding with high power, these facets and scratches may be important and influence negatively the fatigue strength of the rail.

One still knows other reprofiling devices disclosed in the patents DE-26 12 174 and DE-26 12 173 in which grinding units are pivotally mounted on a frame, which is mounted in such a way that it can move vertically with regards to a trolley rolling on the railway track. This trolley is laterally extensible and comprises means leading to spread it so that its flanged wheels are always applied against the inner side of the rail in order to guide the trolley along the railway track. This device comprises, unlike the preceeding one, shaped grinding wheel reprofiling a relatively important length of the perimeter of the head rail's profile and not only a rectilinear small facet of it. On the other hand, these devices are not satisfactory especially in a curve; the reason being that, the length of the trolley being important because it has to carry several grinding units, the guiding of the grinding wheels with regards to the rail is not precise enough an may provoke either the rupture of the grinding wheels or an inadequate and very inacurate reprofiling of the rail.

Furthermore in a warped curve, the supporting strength of the guide roller against the outer rail should be large enough to compensate the retaining strength of the grinding wheel on the one hand and the component of the weight of the trolley on the other hand.

For the inner rail, the supporting strength will be equal and opposite to the one acting on the outer rail added with the component of the trolley's weight, and thus, this supporting strength is very high.

In a curve, due to the relatively great length between the wheels of the trolley (2 meters or more), the deflection between the contact line of the wheels and the support point of the most centered grinding wheel is important (about 5 mm for a curve radius of 100 m.) and for the inner rail of the curve this grinding wheel must support the above-mentioned supporting strength; it generally leads to the rupture of one or several grinding wheels.

In the small radius curve, having a radius between 100 m. and 250 m., the rails are laid with a gauge clearance between 15 mm to 35 mm depending on the railway network and the rolling vehicles.

When grinding rails in those curves use grinding units carried by trolleys which are guided by the rails, the grinding wheel axis is shifted from a value equal to the deflection between the roller of the trolley augmented with the gauge clearance of the railway. This important shift of the grinding wheel's axis provokes a lowering of the inferior grind-stone's axis which may be as important as 50 mm or more for a 45° inclined grinding wheel. This is not acceptable because the grinding wheel interferes notably with the rail fastening which leads to rupture of the grinding wheels.

The device disclosed in the DE-26 12 174 patent, which is relatively simple allows to compensate the gauge clearance of the railway in a small radius curve, but not the deflection of the trolley which is large enough to induce the grinding wheel's rupture as seen before.

Document EP-A-0344390 still discloses a trolley presenting a roller intermediate to the grinding units in order to adjust their orientation and their position with regards to the rail. One should note that the disclosed device works only with a peripheral grinding wheel which induces other drawbacks.

Furthermore, in the devices disclosed in both document DE-26 12 174, and EP-A-0344 390 the tranversally extensible trolleys should apply a very high spacing strength against the flange wheels to compensate in inclination the components of the total weight of the trolley as well as the weight of the grinding units and the grinding supporting force. Because of this important spacing force, the derailment of the trolleys are frequent, especially when the rails present a bevelling wear.

SUMMARY OF THE INVENTION

The aim of the present invention is to implement a railway reprofiling device in which the guiding of the grinding units regarding the rail is very accurate using simple means and that suppresses any risk of derailment of the trolley.

The present invention obviates all of the mentioned drawbacks and allows a perfect reprofiling of the rails.

The present invention overcomes these drawbacks by providing a reprofiling device for the head of at least one rail of a railway track comprising a rigid frame connected to the framing of a railroad vehicle, by lifting means allowing a light running of the railroad vehicle; this frame being guided along the railway track, characterized by the fact that it comprises at least one grinding unit composed of an assembly of at least one grinding wheel, driven in rotation by a motor, each assembly forming a grinding unit which is mounted on a corresponding support so as to move linearly thus allowing the grinding wheel to move towards or away from the surface of the rail; by the fact that the axis of each grinding wheel is located in a plane perpendicular to the longitudinal axis of the rail; by the fact that each support is independently mounted on the frame by translatory motion means allowing the support to move itself along the frame transversally with respect to the rail; and by the fact that each support comprises at least one support roller and resting means, connecting this support to the frame and applying this support roller against one of the inner side of the rail in close proximity to the corresponding grinding unit.

BRIEF DESCRIPTION OF THE DRAWINGS

The accompanying drawings shows schematically and by way of example several modifications of reprofiling devices according to the invention.

DETAILED DESCRIPTION OF THE INVENTION

To solve the grinding wheel's guiding problem explained before, and simultaneously eliminate the facets of reprofiled rail as well as the transversal scratches of the rail, the applicant understood that one should perform a final burnishing phase of the rail with a special burnishing unit which grinding wheel is a shaped grinding wheel, thus in contact with a large curved portion of the head of the rail surface. This shaped grinding wheel should also present a constant eccentricity such that the perpendicular to the radius connecting the grinding wheel's axis to each of its contact points against the rail should be parallel to the axis of the rail. Doing this, one eliminates the facets and the transversal scratches and using the constant eccentricity, that is an accurate positioning of the grinding wheel with respect to the rail and not with the railway track, it is possible to avoid any deterioration of the shaped grinding wheel and to perform a heretofore unachieved precision in the reprofiling of the head of the rail.

Figure 1:
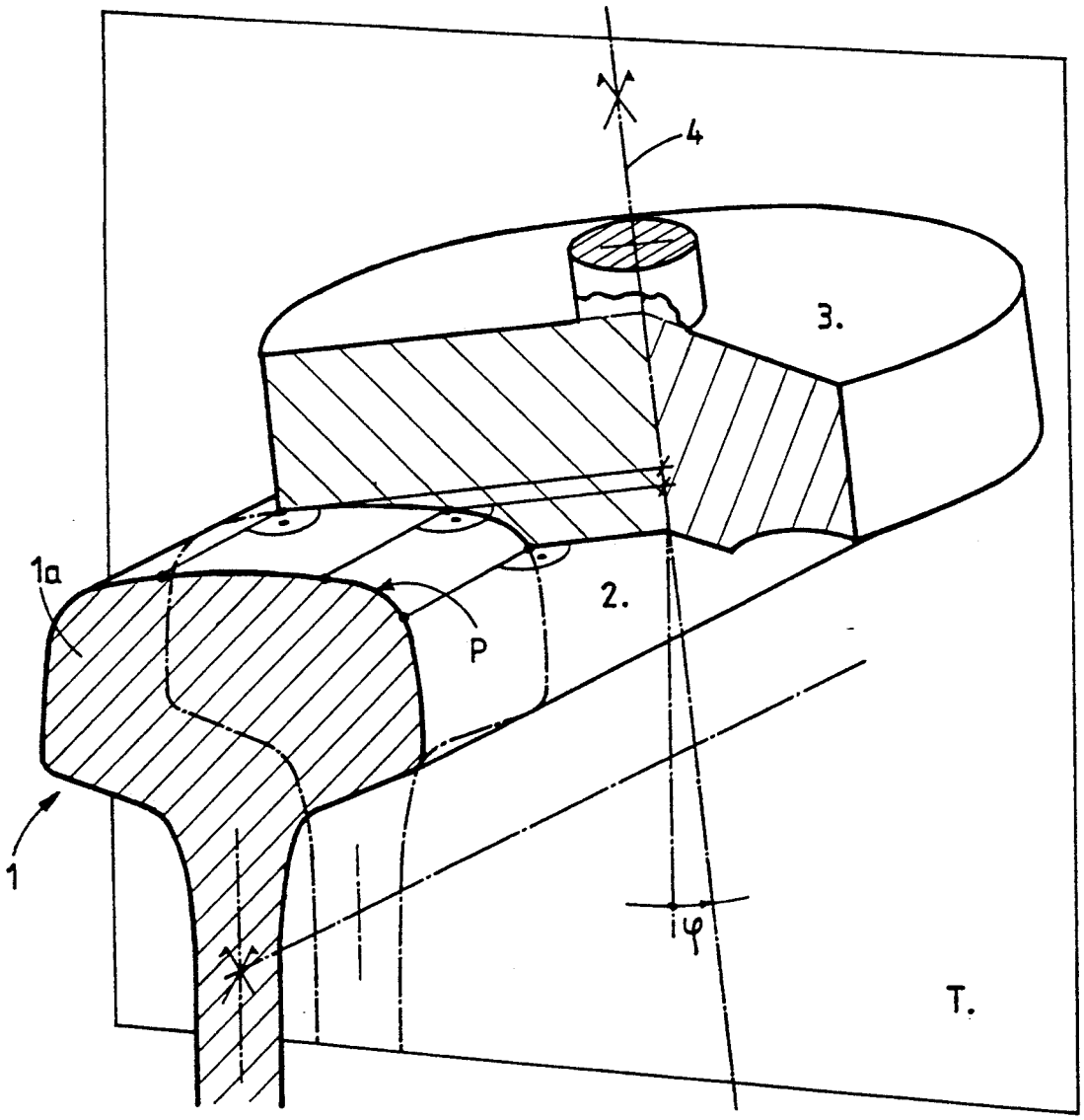
FIG. 1 shows schematically the position of one shaped grinding wheel with regards to the rail.

FIG. 1 shows schematically this concept. One can see the rail 1 with its right section 1*a* which defines the perimeter P of the head 2 of the rail 1. One also sees the shaped grinding wheel 3, which active grinding section presents a shape corresponding to the shape of the portion of the perimeter P to be burnished. The position of this grinding wheel 3 against the rail is eccentric to the longitudinal plane of the rail, the grinding wheel's axis 4 does not intersect the rail 1. The grinding wheel's axis 4 is comprised in a plane T perpendicular to the longitudinal plane of the rail 1 so that the contact line between the head 2 of the rail 1 and the grinding wheel 3 is comprised in this plane T, perpendicular to the longitudinal axis of the rail 1. One understands that to insure such a positioning of the shaped grinding wheel 3 with respect to the rail 1, one needs a very accurate guiding of the grinding wheel regarding the rail 1.

Unlike all the other existing grinding devices in which grinding wheels are guided by a trolley or a railroad vehicle rolling on the railway track, one should, in order to achieve the required accurate guiding, guide the grinding wheel or its support directly on the rail to be grinded, preferably on its inner side because this side of the rail is the least worn and this is where obstacles near the rail do not exist.

Figure 2:
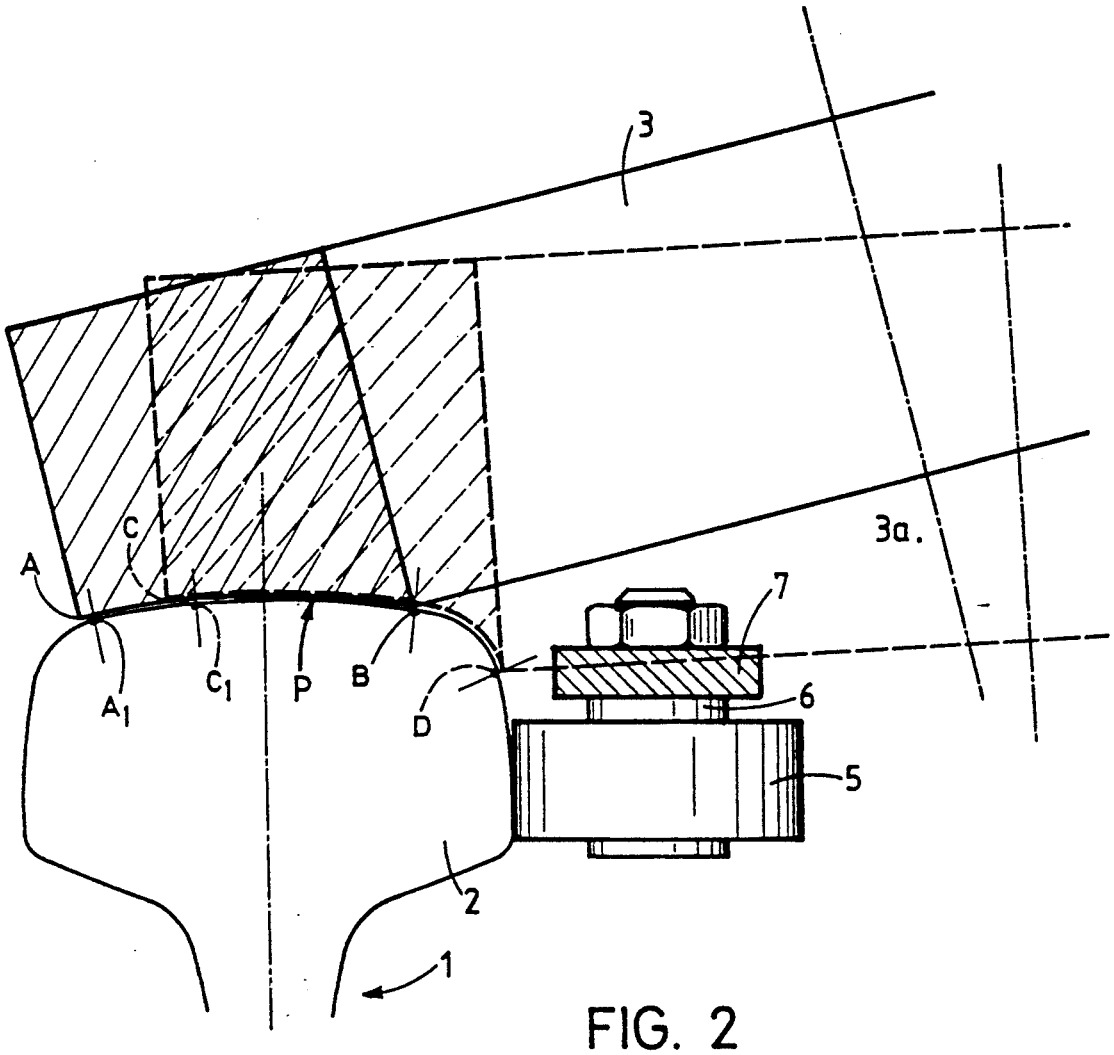
FIG. 2 shows schematically the position of two shaped grinding wheels with regards to the rail.

FIG. 2 shows the principle of the guiding using a roller 5 supported by a spindle 6 which is fastened to the support 7 of the grinding wheel. FIG. 2 also shows schematically the use of two shaped grinding wheels 3,3*a* grinding each a portion (A-B; C-D) of the perimeter P of the head 2 of the rail 1, these portions having a common part on a certain length (C-B). Grinding wheels 3,3*a* are thus guided directly through the rail using the roller 5, this roller being located in very close proximity to the grinding wheels in the longitudinal direction of the rail. The theoretical optimum is to locate this roller in the plane which comprises the axis of the grinding wheel.

One should note that when using two overlapped grinding wheels, the shape of these grinding wheels is such that at the contact point A and C on the perimeter, they are no longer in contact with the rail in order to avoid any longitudinal scratches on the rail. At point A1 and C1 these grinding wheels are tangent to the profile P of the head of the rail. At point B of the perimeter a possible longitudinal scratch created by the extremity of the grinding wheel 3 is automatically erased by the other grinding wheel which is tangent to the profile of the rail at point B.

All the embodiments of the finishing reprofiling device or of the burnishing of the head of the rail device shown comprise a frame 10 mechanically bound to the framing of a railroad vehicle by non illustrated lifting means allowing a light running of the railroad vehicle.

This frame 10 may either be directly bound to the framing of a railroad vehicle, or bound to the railroad vehicle by a trolley, rolling along the railway track, driven by the railroad vehicle; trolley which is lifted up in whole, i.e. with the frame 10, by the lifting means.

When the frame is directly bound to the railroad vehicle, i.e without an intermediate trolley, means are provided to define the low service position of the frame regarding the rail. These means may be either rollers without flanges hinged upon the frame 10 and intended to roll on the surface of the rail or an inferior end stroke stop which limits the vertical downward displacement of the frame 10 regarding the framing of the railroad vehicle.

Thus, the burnishing device is always bound to a railroad vehicle either directly using lifting means or indirectly, being fast with a trolley rolling on the railway track, driven by the railroad vehicle, which is also connected by lifting means allowing a light running of the railroad vehicle.

In most embodiments of the device according to the present invention which are described later on, by way of example, neither the railroad vehicle nor the trolley are shown, only the frame 10 is shown, which frame as seen before, is guided along the railway track either by the railroad vehicle in which it is included or the trolley to which it is bound rolling on the railway track.

Such a guiding, as seen in the introductory part is not accurate enough to insure the grinding quality presently required. The present invention gives a satisfactory answer to this problem.

Figure 3:
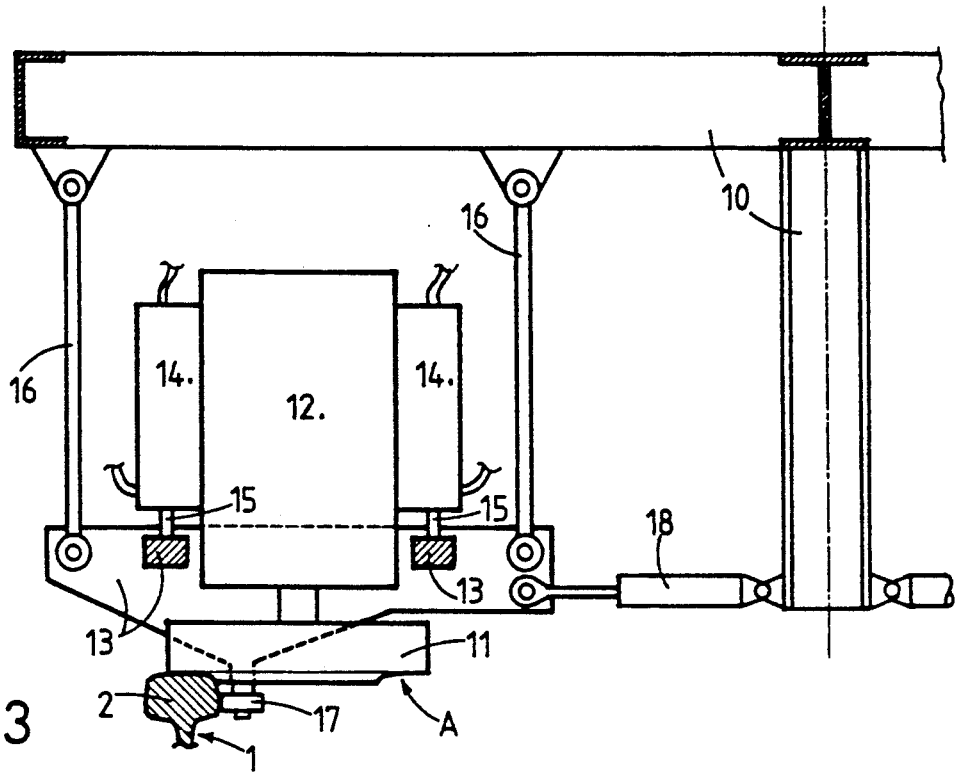
FIG. 3 is an elevation of a first embodiment of the reprofiling device according to the invention.
Figure 4:
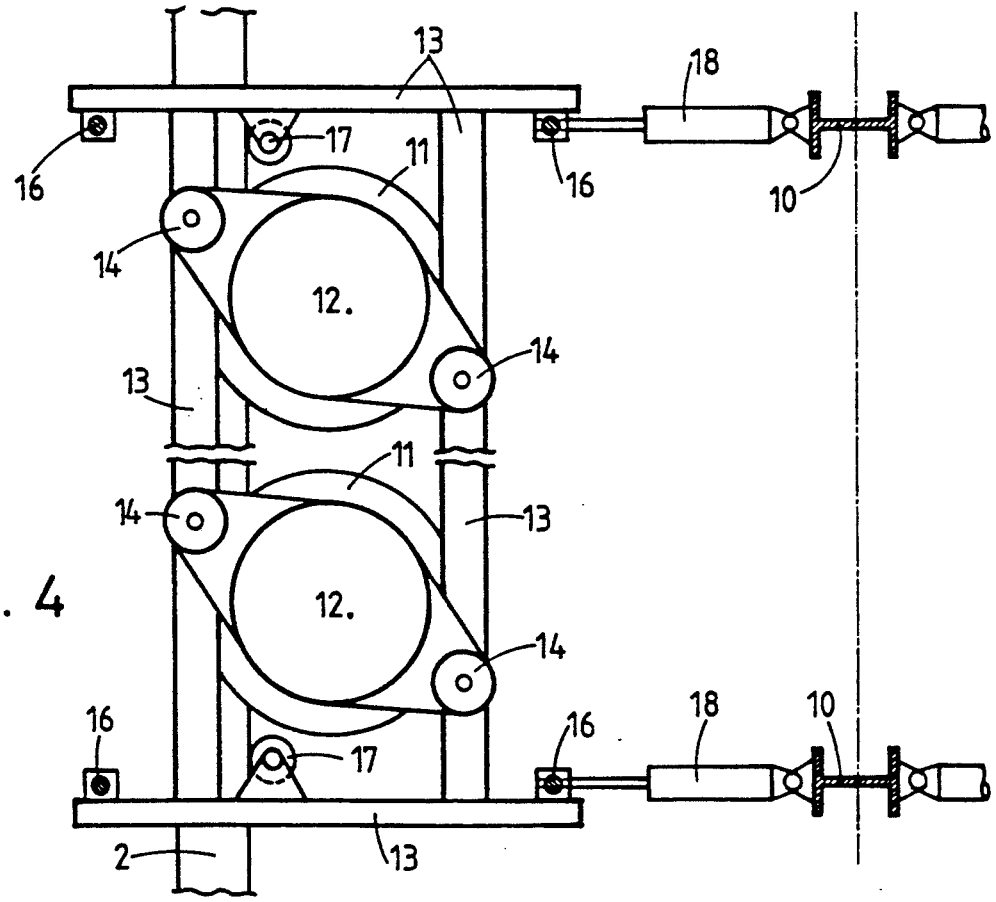
FIG. 4 is an end view of the device shown at FIG. 3.

The first embodiment shown at FIGS. 3 and 4 comprises at least one polishing unit, in this case two, each formed by a burnishing assembly of at least one shaped lapidary grinding wheel 11 driven in rotation by a motor 12. These burnishing assemblies are mounted on a support 13 in a linear moving way so that one can bring forth and back the grinding wheel 11 near the surface of the rail 1 or near the head 2 of the rail whose surface is to be burnished.

The active part A of the frontal shaped lapidary wheel 11 presents a shape corresponding exactly to the shape that one wishes to obtain for the portion of the perimeter P of the head of the rail 1 with which it is in contact.

In this embodiment, means for linearly moving the burnishing unit toward the rail 1 are comprised of two double effect jacks whose cylinders 14 are bound to the motor 12 and whose pistons (not shown) are bound to rods 15 rigidly fastened on the length member of the support 13.

The support 13 is connected to the frame 10 by four cranks 16 articulated on the support 13 at one of its extremities and on the frame 10 on its other extremity along axes which are parallel to the longitudinal axis of the support 13 and therefore approximately parallel to the longitudinal axis of the rail.

The assembly constituted by the frame 10, the support 13 and the cranks 16 forms a deformable parallelogram which permits the support 13 to move itself transversely (i.e. perpendicularly) to the longitudinal axis of the rail. This deformable parallelogram comprises translation means which permit the support 13 to move itself regarding the frame 10, transversally to the rail, i.e. following a direction approximately perpendicular to the longitudinal axis of this rail.

The support 13 comprises at least one support roller, here two of them 17, idly pivoted on vertical shafts, thus perpendicular to the plane of the support. These support rollers are each associated to a burnishing assembly and are located in close proximity to the corresponding grinding wheel's axis.

In the example shown these rollers 17 are intended to come in contact against the inner side of the head 2 of the rail 1 and therefore cannot always be located in a same plane, perpendicular to the longitudinal axis of the rail, as the rotation axis of the corresponding grinding wheel 11, which would be the optimal position to achieve the best guiding of this grinding wheel. This could be achieved when the angle $\delta$ is great enough or in an embodiment in which the rollers 17 would be intended to come into contact with the outer side of the head 2 of the rail. However such a solution is not always possible particularly when obstacles are present on the outside of the rail.

The support 13 is further connected to the frame 10 by two pushing jacks 18 whose respective cylinder is articulated on legs being part of the frame 10 while the rod supporting the piston is articulated on the support 13. With these jacks 18, the roller 17 may be applied against the side of the head of the rail with a predetermined force.

Thus, the guiding of the support and therefore of the burnishing assemblies is achieved in an extremely accurate way, independently of the lateral oscillations of the vehicle or of the trolley and therefore of the frame 10. This guiding is also independent of the weight of both the trolleys and the frame 10. Moreover, the support points of this guiding are located at the immediate proximity of the axis of the grinding wheel 11 so that the precision of the guiding is equally efficient for the rectilinear part of the track and for curves or reverse curves. As a matter of fact, the distance between the two support rollers 17 is very small in comparison with the radius of curvature of the track's curve so that even in the curve, the position of the grinding wheels 11 regarding the rail is always assured of being accurate (within a few tenth of mm.).

With this accurate guiding device it is possible to use shaped lapidary grinding wheels for the burnishing of the rails on the track and thus to remove with a finishing phase the grinding facets, to remove also the transversal scratches due to the grinding wheels's position whose rotational axis is contained in a plane perpendicular to the longitudinal axis of the rail and to avoid any damage of the grinding wheels in view of their accurate guiding directly on the rail independently of the lateral motion of the railroad vehicle or the trolley which carries them and with a reduced strength which is not a function of the weight of both the trolley and the frame 10.

It is obvious that a second support 13 may be used to carry other burnishing assemblies working with the other rail of the track. This second support is then mounted on the frame 10 as described before, symmetrically to the longitudinal axis of the track, i.e. to the longitudinal axis of the frame 10.

Figure 5:
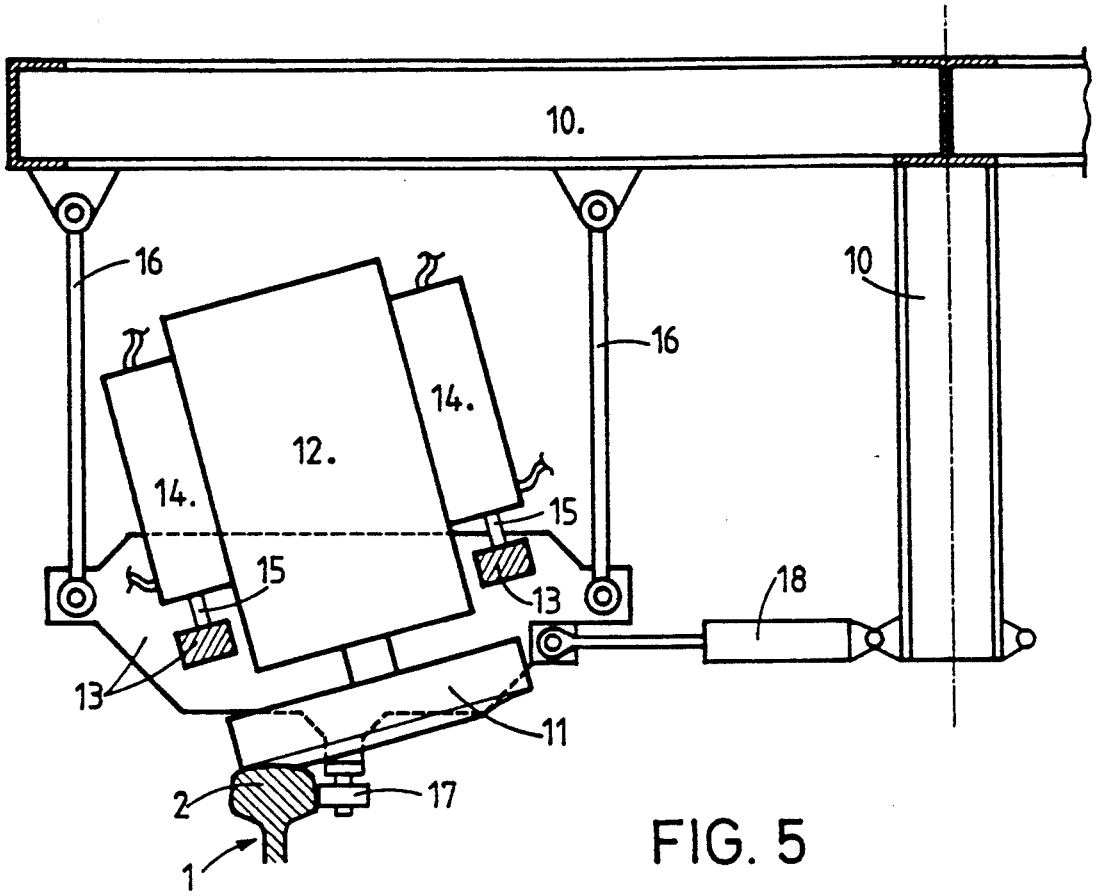
FIG. 5 is an elevation of a second embodiment of the reprofiling device.

FIG. 5 shows a variant of the burnishing unit in which the assembly or the assemblies composed of a motor 12 and a shaped lapidary grinding wheel 11 have always an axis located in a plane perpendicular to the longitudinal axis of the support 13, consequently of the rail, but inclined with an angle $\delta$ (see FIG. 1) with regards to a vertical direction, perpendicular to to the plane of the track. Such an arrangement of the assembly motor 12 - grinding wheel 11 is particularly favorable for the burnishing of the totality of the running surface of the rail and even for a portion of the outside of the rail.

Figure 6:
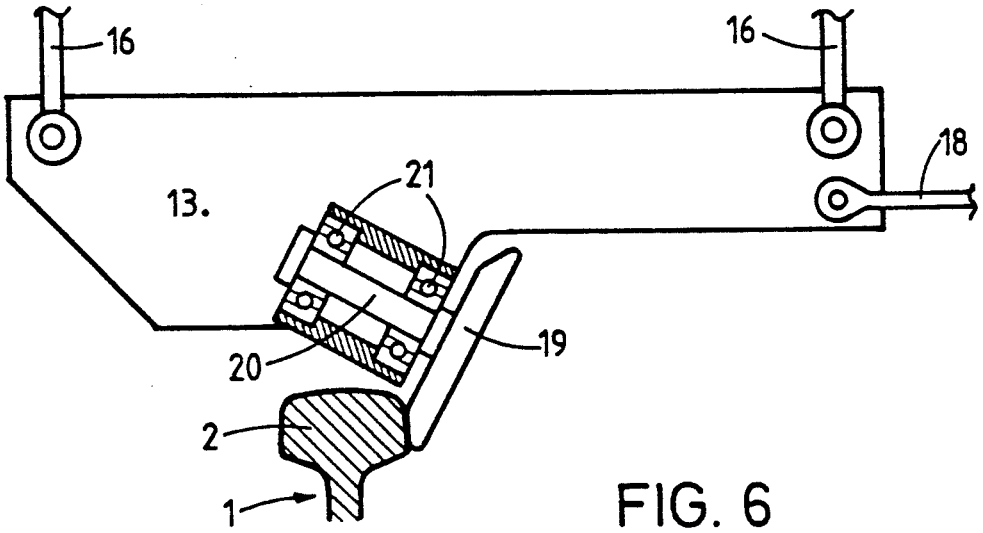
FIG. 6 is a variant of one guide roller of the device.

The variant illustrated at FIG. 6 shows a different realization of the support roller hinged on the support 13. In this embodiment, the roller has the general shape of a chamfered disc 19 fast with a shaft 20 hinged on the support 13 by means of ball bearings 21. This laying out of the roller(s) is particularly interesting because in this way the required space on the inner side of the rail is reduced.

In the previous embodiment, the burnishing device comprises a frame and two burnishing units mounted on a support which, thanks to its binding to the frame, which forms a deformable parallelogram, undergoes a slight elevational variation, i.e. a displacement in the vertical direction, when it is transversally moved with regards to the rail. These elevational variations are slight and may easily be compensated with the stroke of the jacks 14.

Figure 7:
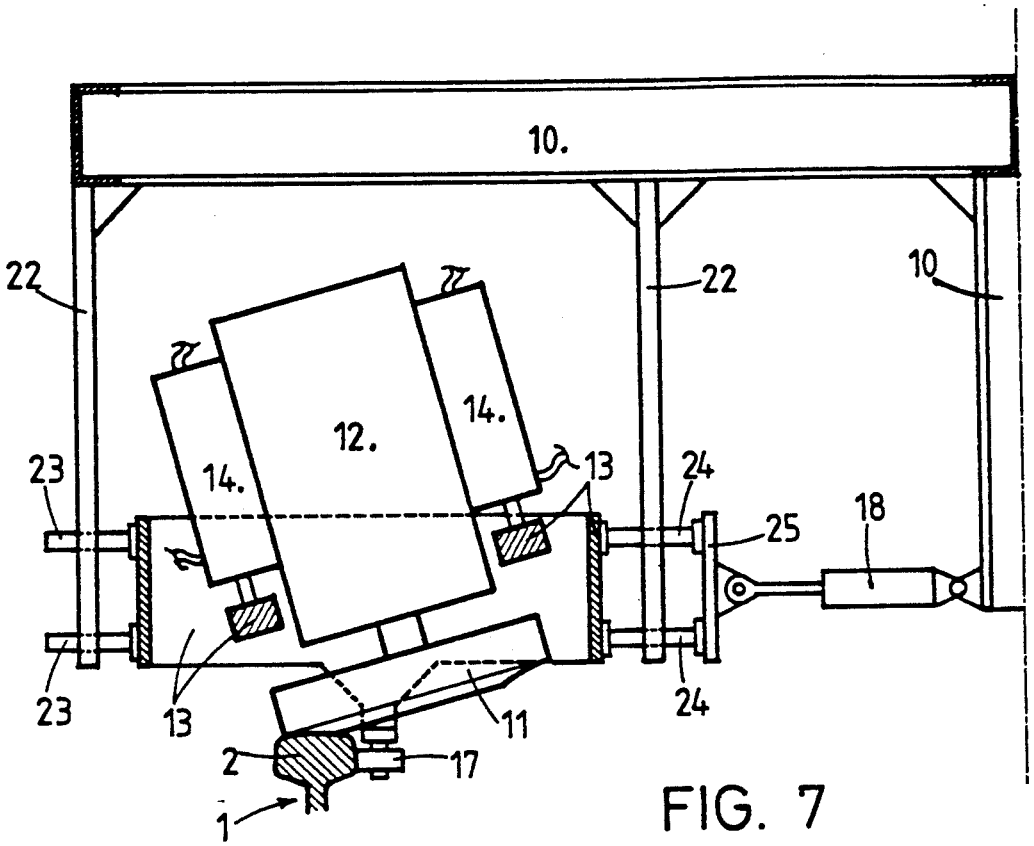
FIG. 7 is an elevation of a third embodiment of the reprofiling device.
Figure 8:
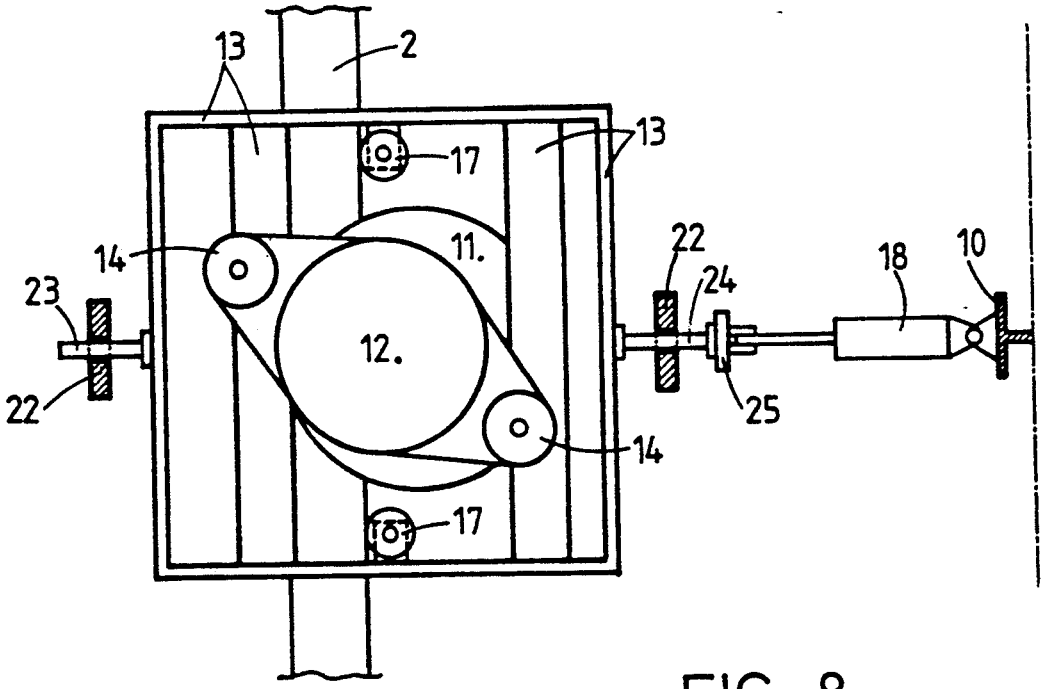
FIG. 8 is a top view of the device as shown at FIG. 7.

Under certain circumstances, one wishes that the transversal displacement of the support with regards to the frame would be absolutely rectilinear. Such an embodiment is illustrated by way of example at FIGS. 7 and 8.

In this embodiment the frame 10 comprises thin bearing plates 22 extending downwardly whose lower extremity comprises two calibrated bores. For each support 13, the frame comprises at least two bearing blades 22 located on either sides of the support.

In this embodiment the support 13 is intended for a burnishing unit comprising a unique assembly grinding wheel 11 - motor 12 always mounted on this support by means of jacks 14.

This support 13 has the general shape of a squared frame having two braces on which are fixed the shaft of the jacks 14. This support 13 also presents two support rollers 17 intended to get in contact against the inner side of the head 2 of the rail.

The frame 13 has two shafts or slides 23, 24 respectively, on each of its lateral side laying perpendiculary to the longitudinal axis of the rail and sliding without play in the calibrated bores of the bearing blades 22. Thus, the support 13 can move itself transversally the rail with regards to the frame 10 in a rectilinear way.

The extremity of the two slides 24 are connected to a plate 25 on which is articulated the shaft of the jack 18 which allows the roller 17 to be applied against the inner side of the head 2 of the rail.

Figure 9:
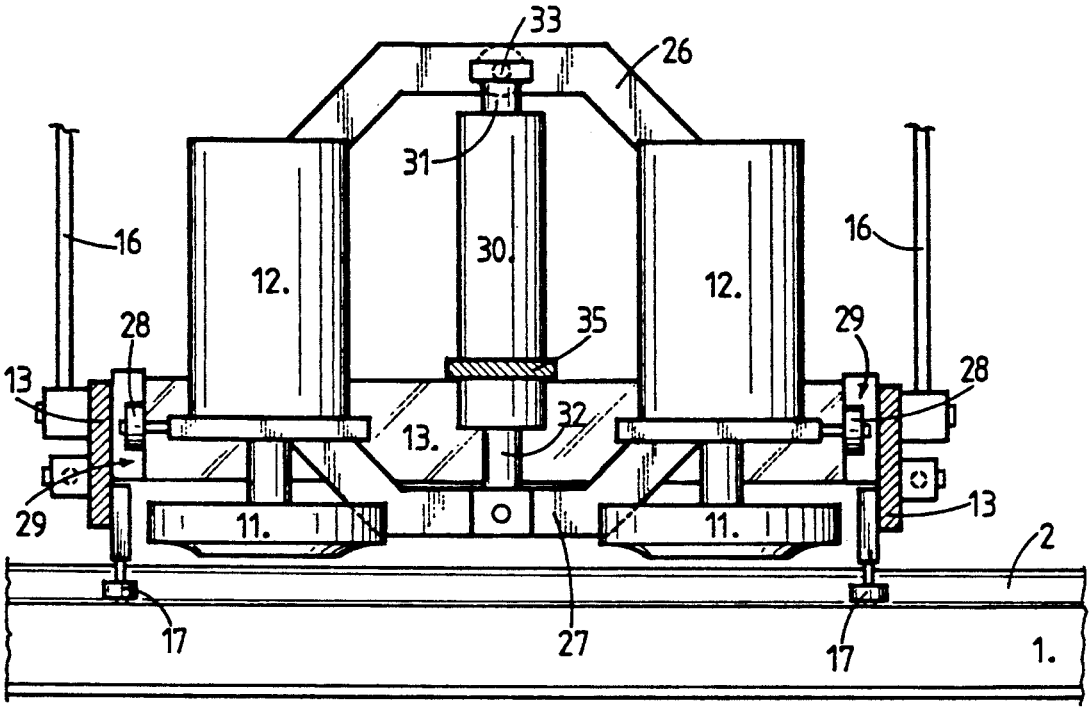
FIG. 9 is an elevation of a fourth embodiment of the reprofiling device.
Figure 10:
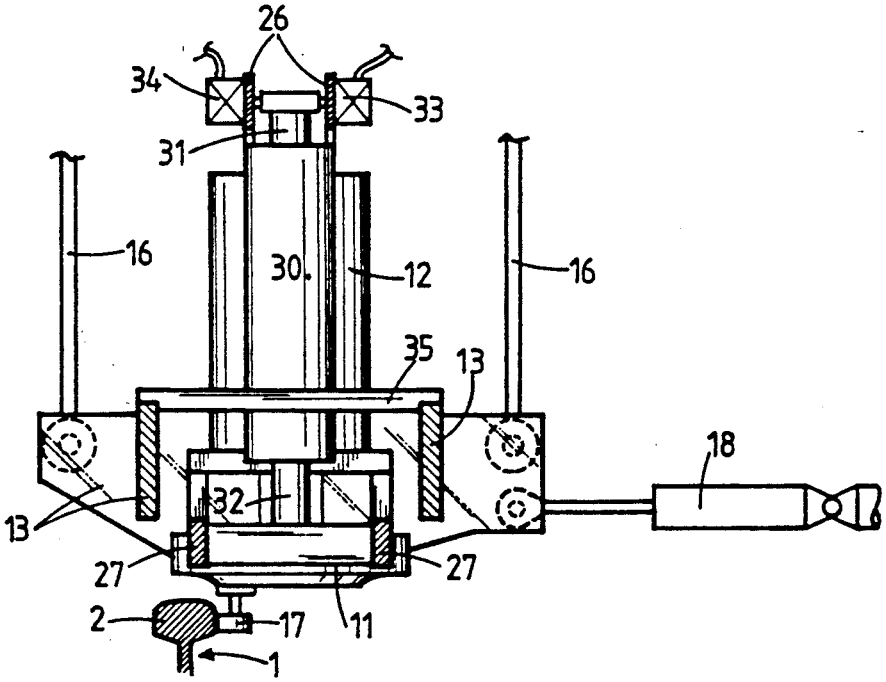
FIG. 10 shows a cross section of the device shown at FIG. 9.

In the embodiment illustrated at FIG. 9 and 10, the burnishing device comprises a support 13, as described at FIGS. 3 and 4, which support is linked to the frame 10 via cranks 16 and jacks 18 and comprises a support roller 17 which contacts the inner side of the head of the rail.

In this embodiment, the burnishing unit comprises two assemblies grinding wheels 11 - motor 12 rigidly linked by lower beams 27. The trolley 13 still comprises upper beams 26 fast with the beams 27 of this support. This burnishing unit is provided with guiding rollers 28 cooperating with guides 29 of the support 13 allowing a displacement of the burnishing unit in the direction of the rail with regards to the support 13. This displacement in the direction of the rail is driven by a central jack 30 whose piston is connected to an upper shaft 31 whose extremity is slidably mounted between the upper beams 26 while the central jack's lower shaft 27 is articulated on the lower beams 27. Locking devices 33,34 permit the immobilization of the upper shaft 31 against the beams 26. During operation, locking devices 33,34 are unlocked, thus, when both grinding units assemblies are moved simultaneously relative to the rail using to the central jack 30, the support strength of the two grinding wheels counterbalance themselves automatically.

It is obvious that two support rollers as described with reference to FIG. 6 may be used in this embodiment of the burnishing unit with two assemblies grinding wheels 11 - motor 12.

In a variant, the two grinding wheels 11 could be driven in rotation by a single motor 12 with the help of an appropriate kinematic link, gear wheel, etc.

Figure 11:
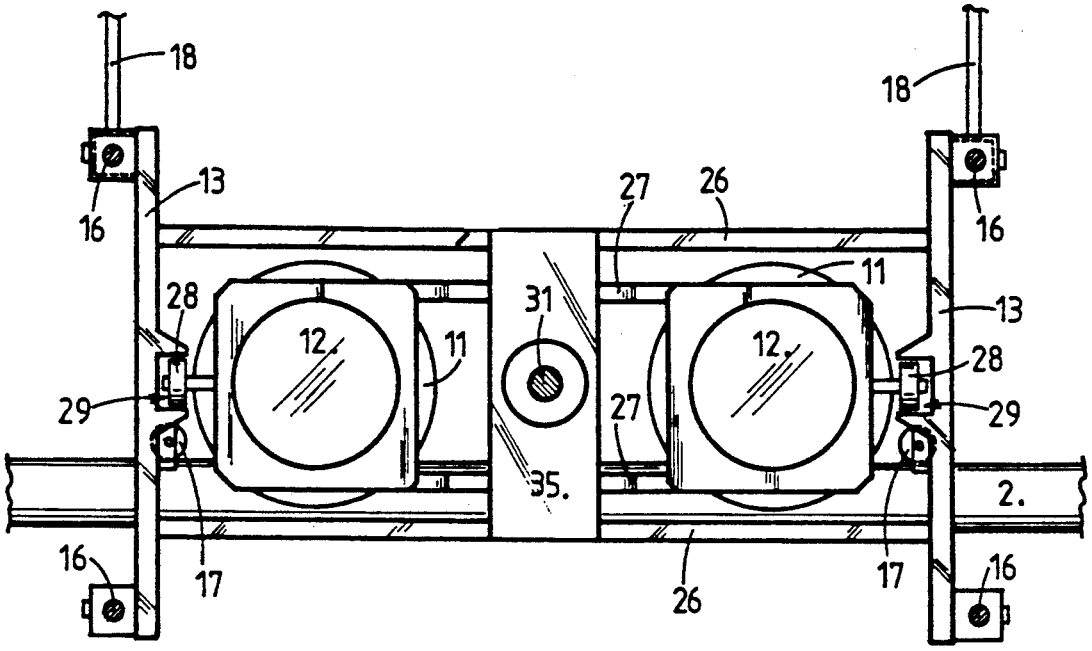
FIG. 11 is a top view of one of the device shown at FIGS. 9 and 10.
Figure 12:
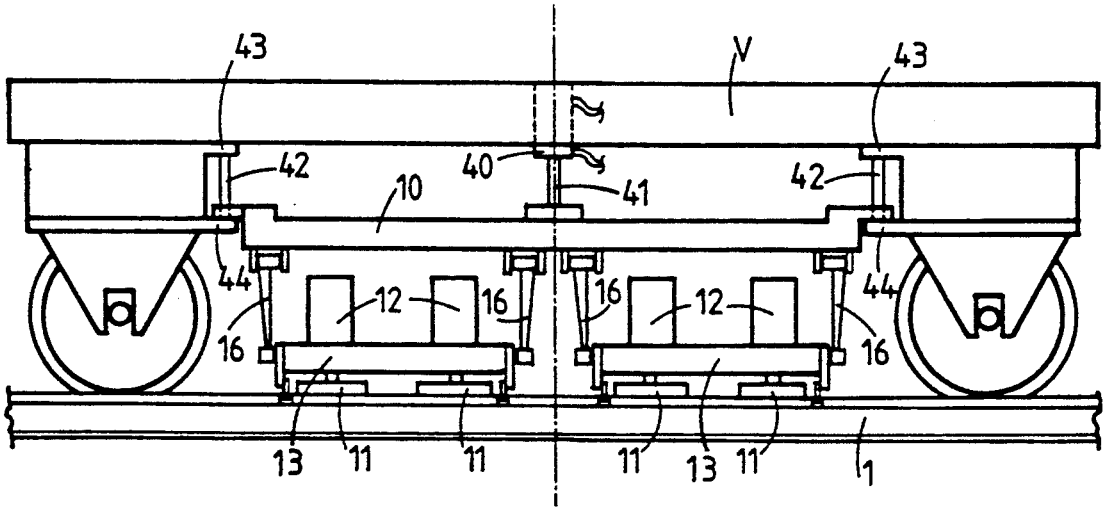
FIG. 12 is a side elevation of the device shown at FIGS. 3 and 4 when mounted on a railroad vehicle.

FIGS. 11 and 12 show an embodiment in which the burnishing device frame 10 is mounted directly on a railroad vehicle V by lifting means, here formed by a double effect jack whose cylinder 40 is connected to the railroad vehicle, while the shaft 41 which carries its piston, is connected to frame 10.

This frame 10 may therefore be displaced vertically relative to the railroad vehicle V and is guided in its displacement by the guide 42 connected to the railroad vehicle V sliding in appropriate passages of the frame 10. The stroke of the frame 10 with respect to the vehicle is limited downward as well as upward. The frame 10 contacts with parts of the vehicle V which constitutes upper end stop 43 and lower end stop 44.

In this embodiment, each frame 10 bears two supports 13 on each stretch of rails and each support 13 supports a burnishing unit which comprises two assemblies grinding wheels 11 - motor 12. These supports 13 and their burnishing units are as described with reference to FIGS. 9 and 10.

Figure 13:
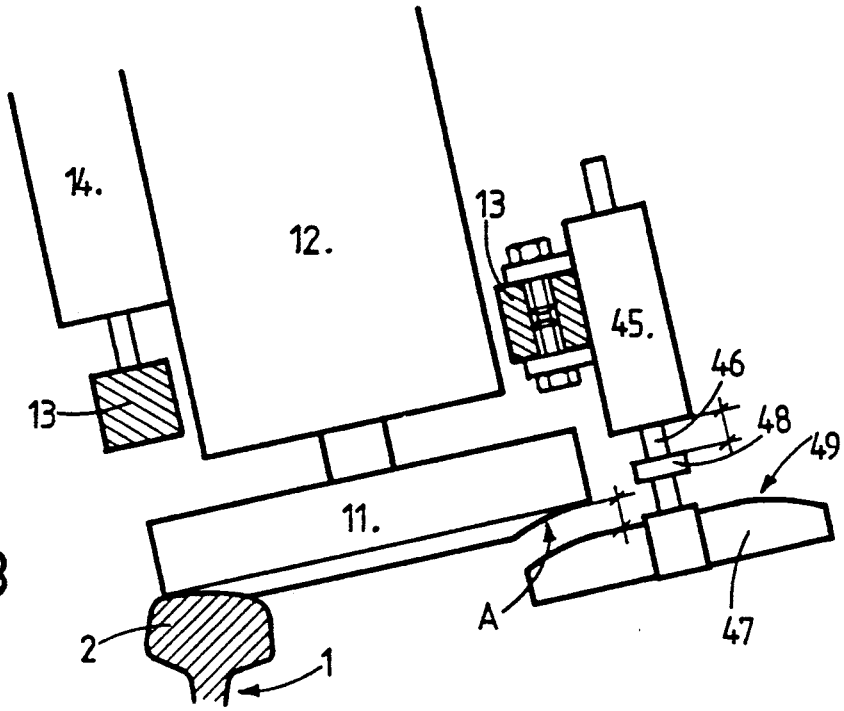
FIGS. 13 and 14 show a detail of a grinding unit comprising a rectifing tool of the shaped grinding wheel.

Under certain circumstances where the burnishing precision has to be especially high, one can provide the support 13 with a rectification tool shaped as the grinding wheel 11. FIG. 13 shows schematically such a rectification tool. On the support 13 is fixed a double effect jack 45 whose shaft 46, driven by the piston, is equipped with a stop 48, and supports at its extremity a rectification tool 47, rotating or not, whose section 49 corresponds to the desired shape of the active part A of the front side of the lapidary grinding wheel 11. To rectify the grinding wheel 11, it is enough to bring the rectification tool 47 near the grinding wheel using the jack 45, while the grinding wheel is working on the rail.

Figure 14:
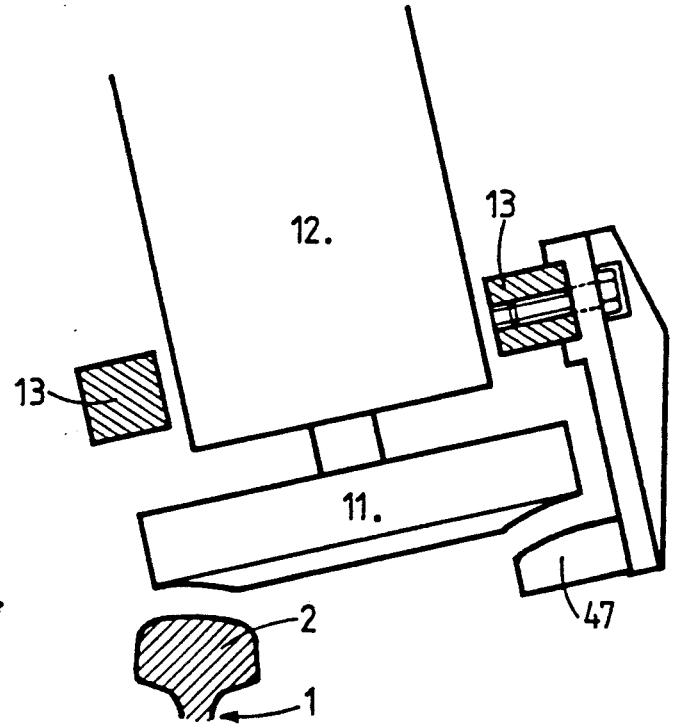

FIG. 14 shows a variant of this grinding wheel's rectification tool in which the tool 47 is rigidly fixed to the support 13. In this case, to rectify the grinding wheel when it is not working, the grinding wheel is moved forward in the direction of the tool 47 by the pushing jacks 14 of the burnishing unit.

Many variants of the described burnishing device may be thought off, notably it is possible by changing the inclination of the axis of the assemblies grinding wheel 11 - motor 12, always located in a plane perpendicular to the longitudinal axis of the rail, to grind each part of the head of the rail i.e. the rolling surface, the inner and the outer sides of the rail.

To obtain an optimal guiding, notably in curves, one needs one roller for each grinding wheel, located if possible in the plane perpendicular to the rail and comprising the grinding wheel's axis. The space required for the parts generally does not allow such a realization. Thus, the realized construction comprises one roller for each grinding wheel, located as nearly as possible to the plane.

A unique roller for two grinding wheels is also conceivable. This roller is then located between the two grinding wheels of an assembly with two burnishing units. The forward movement of the supporting jacks should then be synchronized to insure a displacement of the suport 13 parallel to the frame's axis. On certain railway network which does not present on obstacle in the immediate vicinity of the rail on the outer side of the track, locating the guide roller in the plane perpendicular to the rail and comprising the grinding wheel's axis is advisable.

The displacement of the grinding wheel along its axis, to compensate its wear, is the best solution because the relative position of the grinding wheel with respect to to the rail stays unchanged. However, a displacement along a different direction is conceivable. By way of example in the case of a group of two grinding wheels having different inclination, it is expedient to choose for the displacement a direction in between the two inclinations.

In the previously described embodiments, the device is more paticularly intended to perform fine grinding or burnishing of the rail in order to remove any scratches or facets. This is why, in the disclosed devices, one uses shaped grinding wheels whose axis does not intersect with the longitudinal axis of the rail.

But thanks to the design of the present grinding device, it is possible to radically improve the guiding of grinding units bearing lapidary grinding wheels with a planar surface or peripheral grinding wheels for the intensive grinding of the rail.

Figure 15:
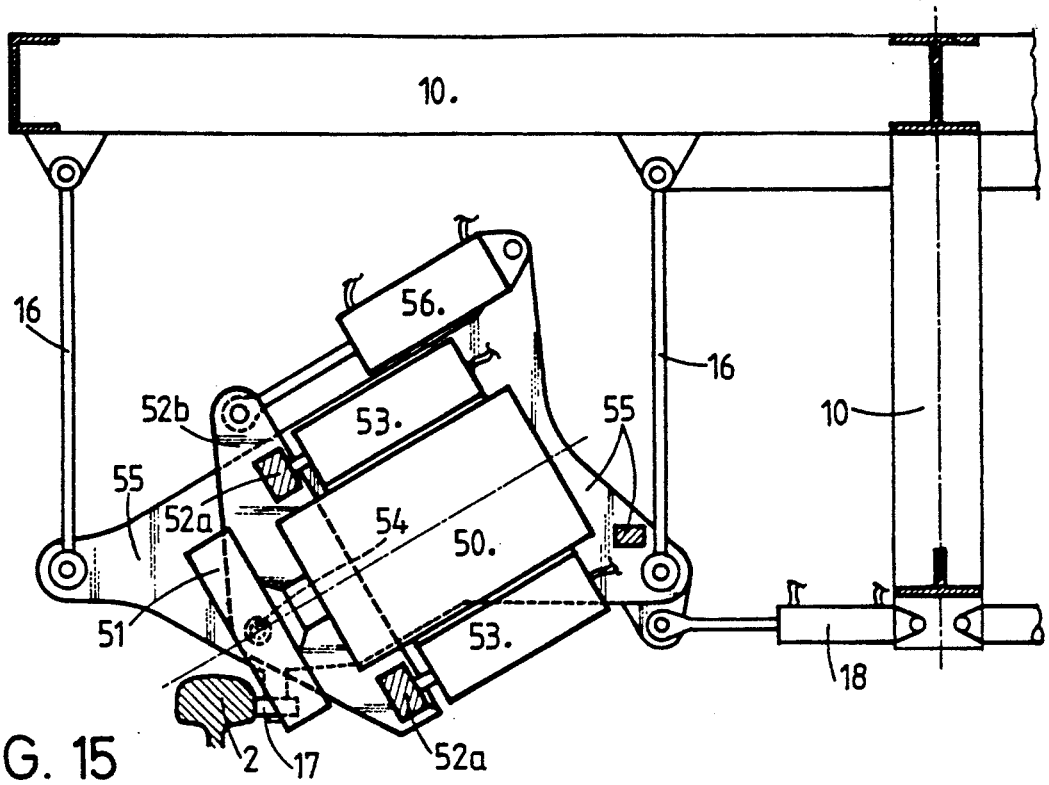
FIGS. 15 and 16 show a variant of the reprofiling device.
Figure 16:
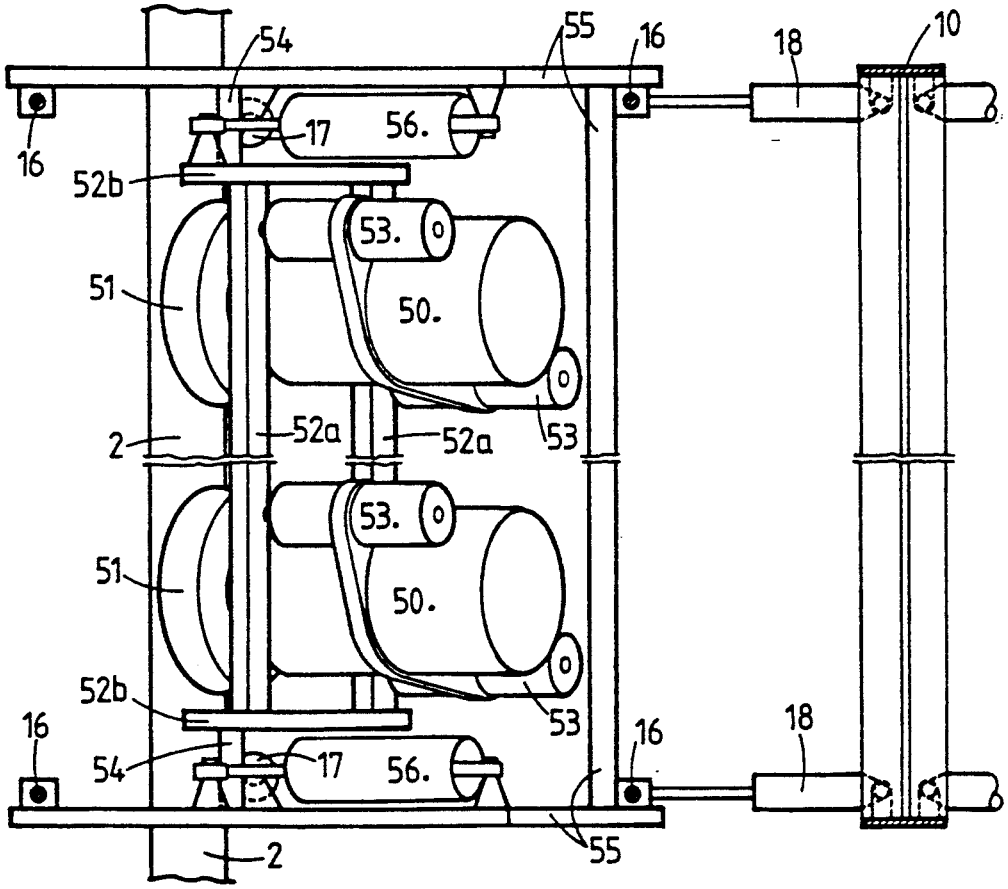

FIGS. 15 and 16 show such an application of the device according to the invention, similar to those shown in FIGS. 3 and 4 but using a lapidary grinding wheel with a planar frontal face for each grinding unit and in which grinding units can in addition move around an axis parallel to the longitudinal axis of the rail.

In this embodiment, each grinding unit is composed of a motor 50 whose shaft drives in rotation a lapidary grinding wheel 51. This lapidary grinding wheel 51 presents a planar frontal working face and thus is able to support heavy loads and to perform if necessary an intensive grinding of the head 2 of the rail 1.

Both grinding units are mounted on a framing 52 by means of jacks 53 which these units to move linearly with regards to the framing 52 parallel to the motor's shaft and thus perpendicular to the longitudinal axis of the rail. The framing 52 is made of bar girders **52*a* and ending plates 52*b* which are pivoted on the spindles 54 connected to a support 55. Double effect jacks 56 enable to set and position the framing 52 angularly with respect to the support 55 and thus determine the longitudinal area of the head 2 of the rail on which the grinding wheel 51** will work.

The support 55 is connected, as in other embodiments, to the frame 10 by cranks 16 a jack 18 permits to apply the support's rollers 17 against the inner side of the rail.

I claim:

1. Device for grinding a surface of a head of at least one rail of a railway track comprising a rigid frame connected to a framing of a railroad vehicle, by lifting means allowing a light running of the railroad vehicle; the frame being guided along the railway track, said device further comprising at least one grinding unit composed of an assembly of at least one grinding wheel, driven in rotation by a motor, each assembly being mounted on a corresponding support and being able to move linearly thereby allowing the grinding wheel to move towards and away from the surface of the rail to be ground; each grinding wheel having an axis located in a plane perpendicular to the longitudinal axis of the rail; each support being independently mounted on the frame by translatory motion means, which together with the frame and the support form a deformable parallelogram which permits the support to move itself relative to the frame and transversely with respect to the rail; each support comprising at least one support roller, and resting means connecting said support to the frame and including means for applying said support roller against one of the sides of the rail in close proximity to the corresponding grinding unit.

2. Device according to claim 1, wherein the frame is connected to a trolley adapted to roll on the railway track and driven by a railroad vehicle.

3. Device according to claim 1, wherein the frame is directly connected to the railroad vehicle by lifting and guiding means.

4. Device according to claim 1, wherein the grinding unit comprises several assemblies each made up of one grinding wheel and its driving motor.

5. Device according to claim 4, wherein the rotation axis of the grinding wheels of all the assemblies are parallel.

6. Device according to claim 4, wherein the grinding wheels have different inclinations with respect to the rail, and the grinding unit is displaced towards the rail in a direction between the inclinations.

7. Device according to claim 1, further including as many support rollers as grinding wheels.

8. Device according to claim 1, further including two support rollers for each grinding wheel.

9. Device according to claim 1, wherein the grinding wheel is shaped, and a contact line between the grinding wheel and the surface of the rail is located in a plane perpendicular to the longitudinal axis of the rail.

10. Device according to claim 1, wherein the grinding wheel presents a planar grinding face; said grinding unit being mounted on a framing articulated on the support around an axis parallel to the longitudinal axis of the rail; and said device further includes means for determining an angular service position of said framing with respect to the support.

* * * * *